US007241194B2

(12) United States Patent
Tawa et al.

(10) Patent No.: US 7,241,194 B2
(45) Date of Patent: Jul. 10, 2007

(54) OUTBOARD MOTOR HYDRAULIC MECHANISM

(75) Inventors: Hiroki Tawa, Wako (JP); Hideaki Takada, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/269,199

(22) Filed: Nov. 8, 2005

(65) Prior Publication Data

US 2006/0252316 A1 Nov. 9, 2006

(30) Foreign Application Priority Data

Nov. 8, 2004 (JP) ..... 2004-323244

(51) Int. Cl.
*B63H 5/125* (2006.01)
*B63H 5/20* (2006.01)

(52) U.S. Cl. ..... 440/61 S; 440/53

(58) Field of Classification Search ..... None
See application file for complete search history.

(56) References Cited

U.S. PATENT DOCUMENTS 5,006,086 A * 4/1991 Latham ..... 440/88 R
2005/0282448 A1* 12/2005 Tawa et al. ..... 440/61 S

FOREIGN PATENT DOCUMENTS

JP 06-127475 5/1994

* cited by examiner

*Primary Examiner*—Jesus Sotelo
*Assistant Examiner*—Daniel V. Venne
(74) *Attorney, Agent, or Firm*—Carrier, Blackman & Associates, P.C.; Joseph P. Carrier; William D. Blackman

(57) ABSTRACT

An outboard motor hydraulic mechanism having a hydraulic actuator moving the outboard motor about a rotary shaft relative to a boat the motor is mounted on and a hydraulic pump and a plurality of electric motors connected to the pump. A number of the motors to be operated is determined based on an estimated load acting on the actuator, output shafts of the motors are aligned coaxially with a drive shaft of the pump, and they are directly connected with each other. This ensures that the operator is prevented from having an unpleasant feeling, lowers electric power consumption by the motors, and reduces the number of components and simplifies the structure of the mechanism.

10 Claims, 7 Drawing Sheets

OUTBOARD MOTOR HYDRAULIC MECHANISM

BACKGROUND OF THE INVENTION

This invention relates to an outboard motor hydraulic mechanism, more particularly an outboard motor hydraulic mechanism for driving a rotary shaft provided on an outboard motor by a hydraulic actuator to move the outboard motor about the rotary shaft relative to a boat (hull).

DESCRIPTION OF THE RELATED ART

A conventional way of regulating the steering angle or tilt/trim angle of an outboard motor is to use a hydraulic actuator to drive a rotary shaft such as a swivel shaft or tilting shaft provided on the outboard motor mounted on a boat (hull), thereby rotating the outboard motor about the rotary shaft so as to move or rotate it relative to the boat, as taught, for example, by Japanese Laid-Open Patent Application No. Hei 6(1994)-127475, particularly paragraphs 0014 to 0016 and FIG. 1.

The load acting on the hydraulic actuator that drives the rotary shaft, i.e., the driving force the hydraulic actuator is required to produce for regulating the steering angle or tilt/trim angle of the outboard motor varies greatly depending on, for instance, the type of boat (hull), boat speed, wave height and the like. In order to operate the hydraulic actuator, there are required a hydraulic pump that supplies hydraulic (operating) fluid to the hydraulic actuator and an electric motor that drives the hydraulic pump. If the output torque of the motor for driving the hydraulic pump is insufficient, the speed at which the hydraulic actuator is driven varies with load variation, so that the operator is given an unpleasant feeling.

Therefore, in order to maintain stable operation of the hydraulic actuator in spite of load fluctuations, the hydraulic pump is ordinarily driven by a motor that can produce enough torque to cope with the maximum load anticipated. As a result, the motor outputs more torque than needed when the load acting on the hydraulic actuator is small, so that electric power consumption is greater than necessary.

SUMMARY OF THE INVENTION

An object of this invention is therefore to overcome this drawback by providing an outboard motor hydraulic mechanism that is capable of stably operating the hydraulic actuator for driving the rotary shaft of the outboard motor, thereby ensuring that the operator is not given an unpleasant feeling, and that lowers electric power consumption by the electric motor or motors serving as the power source of the hydraulic pump that supplies hydraulic fluid to the hydraulic actuator.

In order to achieve the object, this invention provides a hydraulic mechanism of an outboard motor adapted to be mounted on a stern of a boat to be movable about a rotary shaft relative to the boat, comprising: a hydraulic actuator which moves the outboard motor about the rotary shaft relative to the boat; a hydraulic pump which supplies hydraulic fluid to the hydraulic actuator; a plurality of electric motors connected to the hydraulic pump; and a motor controller which determines a number of the electric motors to be operated to drive the hydraulic pump based on an estimated load acting on the hydraulic actuator and controlling operation of the determined number of the electric motors; wherein output shafts of the electric motors are aligned coaxially with a drive shaft of the hydraulic pump, and the output shafts of the electric motors are directly connected with the drive shaft of the hydraulic pump.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

An embodiment of an outboard motor hydraulic mechanism according to the present invention will now be explained with reference to the attached drawings.

Figure 1:
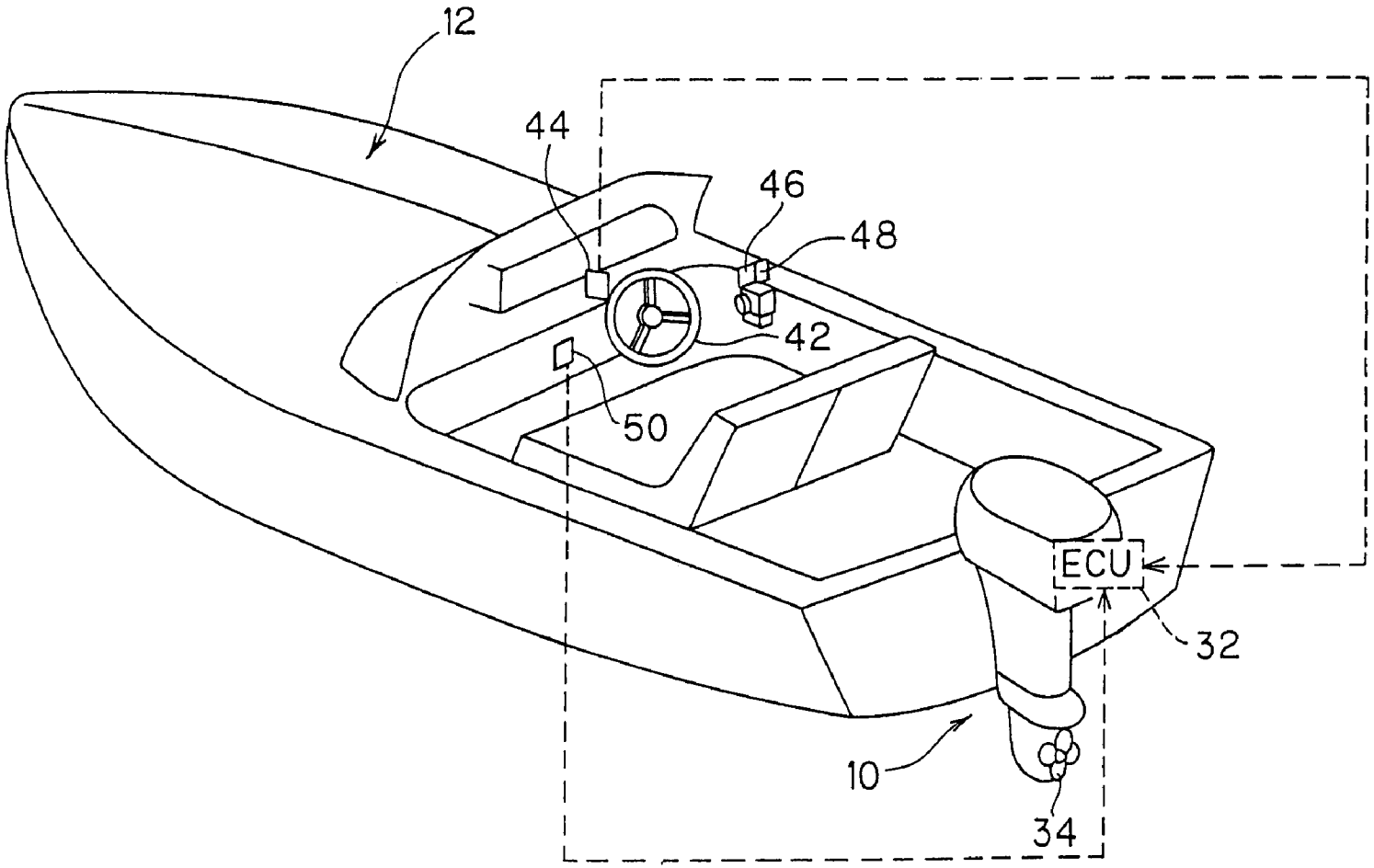
FIG. 1 is an overall schematic view of an outboard motor including a hydraulic mechanism according to an embodiment of the invention, and mounted on a boat (hull)
Figure 2:
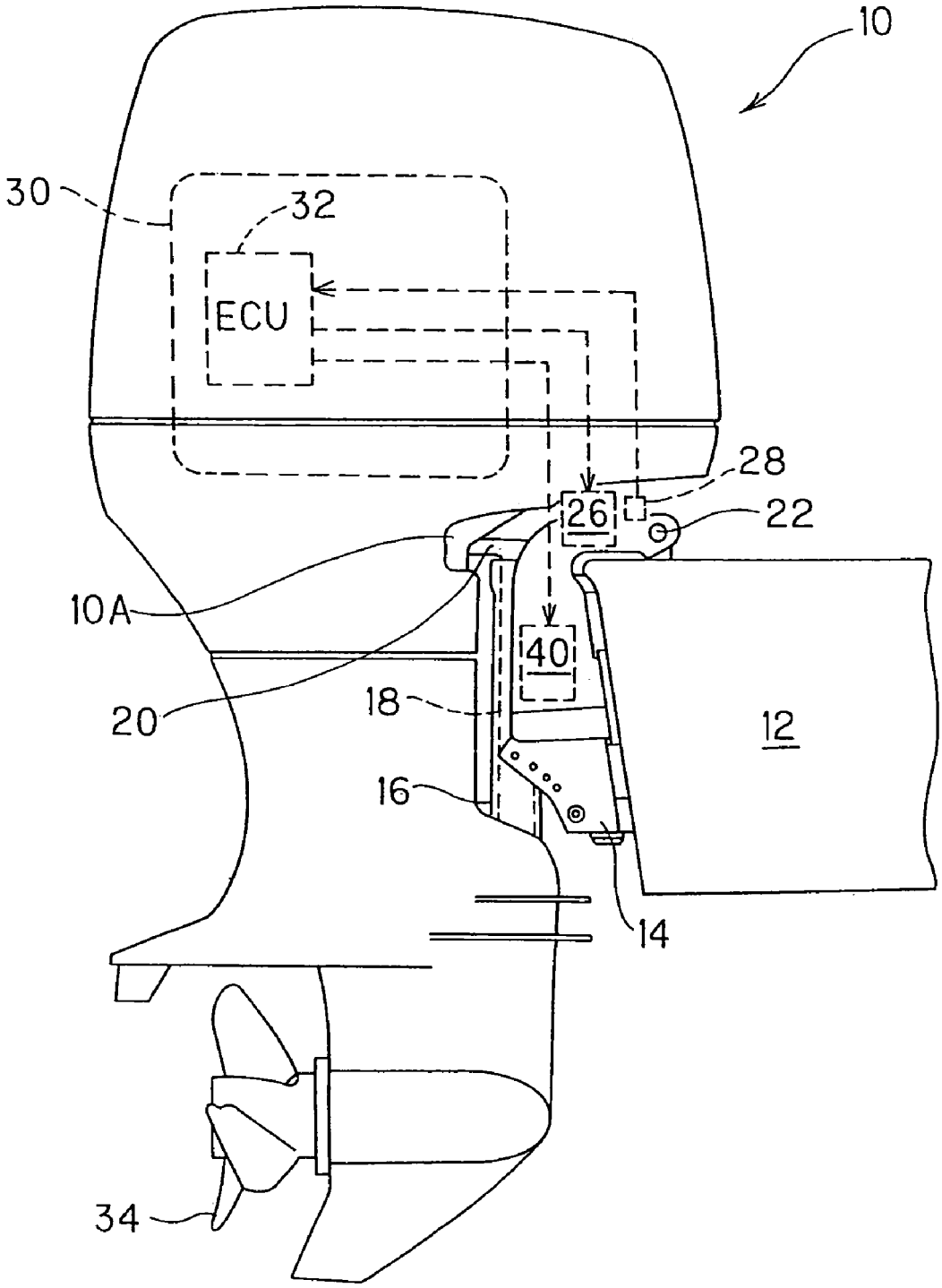
FIG. 2 is a partial side view of the motor and hydraulic mechanism shown in FIG. 1.

FIG. 1 is an overall schematic view of an outboard motor including a hydraulic mechanism according to an embodiment of the invention and mounted on a boat (hull), and FIG. 2 is a partial side view of the motor and hydraulic mechanism shown in FIG. 1.

In FIGS. 1 and 2, reference numeral 10 indicates an outboard motor. As shown in FIG. 2, the outboard motor 10 is mounted on a boat (hull) 12 through stem brackets 14 fastened to the stern of the boat 12, a swivel case 16 attached to the stem brackets 14 and a swivel shaft 18 rotatably housed in the swivel case 16.

The upper end of the swivel shaft 18 is fastened to a frame 10A of the outboard motor 10 via a mount frame 20 and the lower end thereof is also fastened to the frame 10A via a connecting member (not shown). The swivel case 16 is attached to the stem brackets 14 through a tilting shaft (horizontal axis) 22. With this, the outboard motor 10 is freely steered or moved about the swivel shaft (vertical axis) 18 as a rotational axis (i.e., freely steered to the right and left directions) with respect to the boat 12, and is freely rotated or moved about the tilting shaft 22 as a rotational axis to freely regulate a tilt/trim angle.

The upper portion of the swivel case 16 is installed with a hydraulic actuator (double-acting hydraulic cylinder; hereinafter referred to as the "steering hydraulic cylinder") 26 that regulates a steering angle of the outboard motor 10 by driving the swivel shaft 18. A stroke sensor 28 attached to the steering hydraulic cylinder 26 generates an output or signal indicative of a driven amount of the steering hydraulic cylinder 26 (specifically a stroke of the piston of the cylinder 26; i.e., a rotational amount of the swivel shaft 18 or the steered angle of the outboard motor 10).

An internal combustion engine (hereinafter referred to as the "engine") 30 is disposed in the upper portion of the outboard motor 10. The engine 30 comprises a spark-ignition, in-line, four-cylinder, four-cycle gasoline engine with a displacement of 2,200 cc. An electronic control unit (ECU) 32 comprising a microcomputer is disposed near the engine 30.

A propeller 34 is provided at the lower portion of the outboard motor 10. The propeller 34 is rotated by the power of the engine 30 whose output is transmitted via a crankshaft, drive shaft, gear mechanism and shift mechanism (none of which is shown), thereby generating a thrust to propel the boat 12 in the forward and reverse directions.

A hydraulic actuator, specifically a known power tilt-trim unit 40, that regulates a tilt/trim angle of the outboard motor 10 by driving the tilting shaft 22 is installed near the stem brackets 14 and swivel case 16.

As shown in FIG. 1, a steering wheel 42 is installed near a cockpit (operator's seat) of the boat 12, and a steering wheel sensor 44 is installed at a rotational axis of the steering wheel 42. The steering wheel sensor 44 comprising a rotary encoder generates an output or signal in response to the rotation angle (manipulated variable) of the steering wheel 42 manipulated by the operator.

A shift lever 46 and a throttle lever 48 installed near the cockpit are connected to the shift mechanism and to a throttle valve (not shown) of the engine 30 through push-pull cables. Specifically, the manipulation of the shift lever 46 causes the shift mechanism to operate, thereby changing the moving direction of the boat 12. Further, the manipulation of the throttle lever 48 causes the throttle valve to open and close, thereby regulating the engine speed, i.e., the vessel speed of the boat 12.

A power tilt-trim switch 50 for inputting an instruction by the operator to regulate the tilt/trim angle of the outboard motor 10 is also installed near the cockpit. The switch 50 comprises a see-saw switch having up and down sides and generates an output or signal in response to up/down instructions of tilt/trim angle inputted by the operator. The outputs from the stroke sensor 28, steering wheel sensor 44 and power tilt-trim switch 50 are sent to the ECU 32.

Based on the outputs from the stroke sensor 28, steering wheel sensor 44 and power tilt-trim switch 50, the ECU 32 controls the operation of the steering hydraulic cylinder 26 to regulate the steering angle of the outboard motor 10 and the operation of the power tilt-trim unit 40 to regulate the tilt/trim angle of the outboard motor 10.

Figure 3:
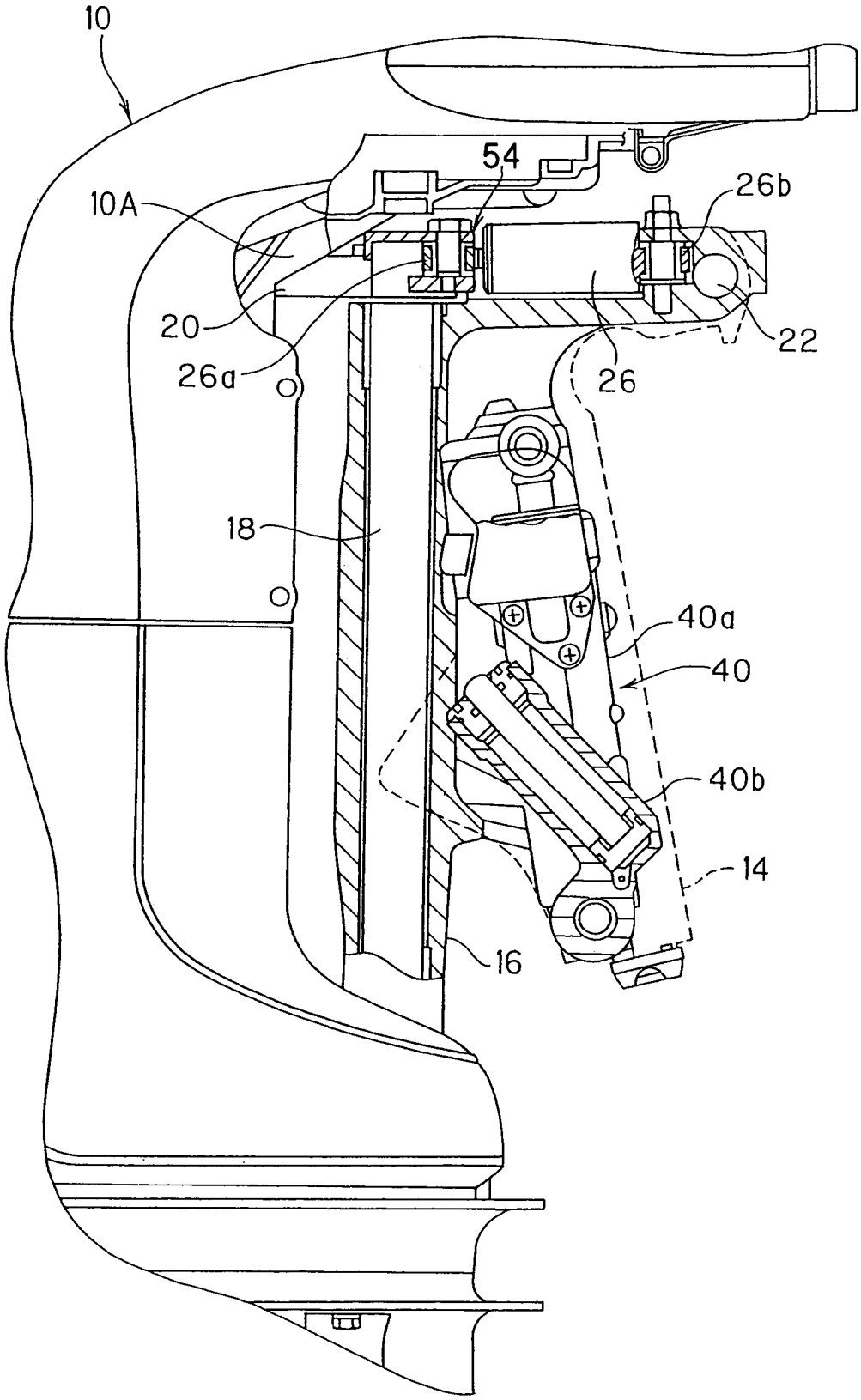
FIG. 3 is an enlarged partial sectional view showing the vicinity of a swivel case shown in FIG. 2.

FIG. 3 is an enlarged partial sectional view showing the vicinity of the swivel case 16 shown in FIG. 2.

As illustrated in FIG. 3, the power tilt-trim unit 40 integrally comprises a hydraulic cylinder for adjusting the tilt angle (only one shown; hereinafter called the "tilt hydraulic cylinder") 40*a*, and two hydraulic cylinders for adjusting the trim angle (hereinafter called the "trim hydraulic cylinders") 40*b*. The tilt hydraulic cylinder 40*a* and trim hydraulic cylinders 40*b* are the double-acting hydraulic cylinders.

A cylinder bottom of the tilt hydraulic cylinder 40*a* is fastened to the stern brackets 14 and a rod head thereof abuts on the swivel case 16. A cylinder bottom of each trim hydraulic cylinder 40*b* is fastened to the stem brackets 14 and a rod head thereof abuts on the swivel case 16. Thus, when the tilt hydraulic cylinder 40*a* or the trim hydraulic cylinders 40*b* are driven (extend and contract), the swivel case 16 rotates about the tilting shaft 22 as a rotational axis, thereby regulating the tilt/trim angle of the outboard motor 10.

Figure 4:
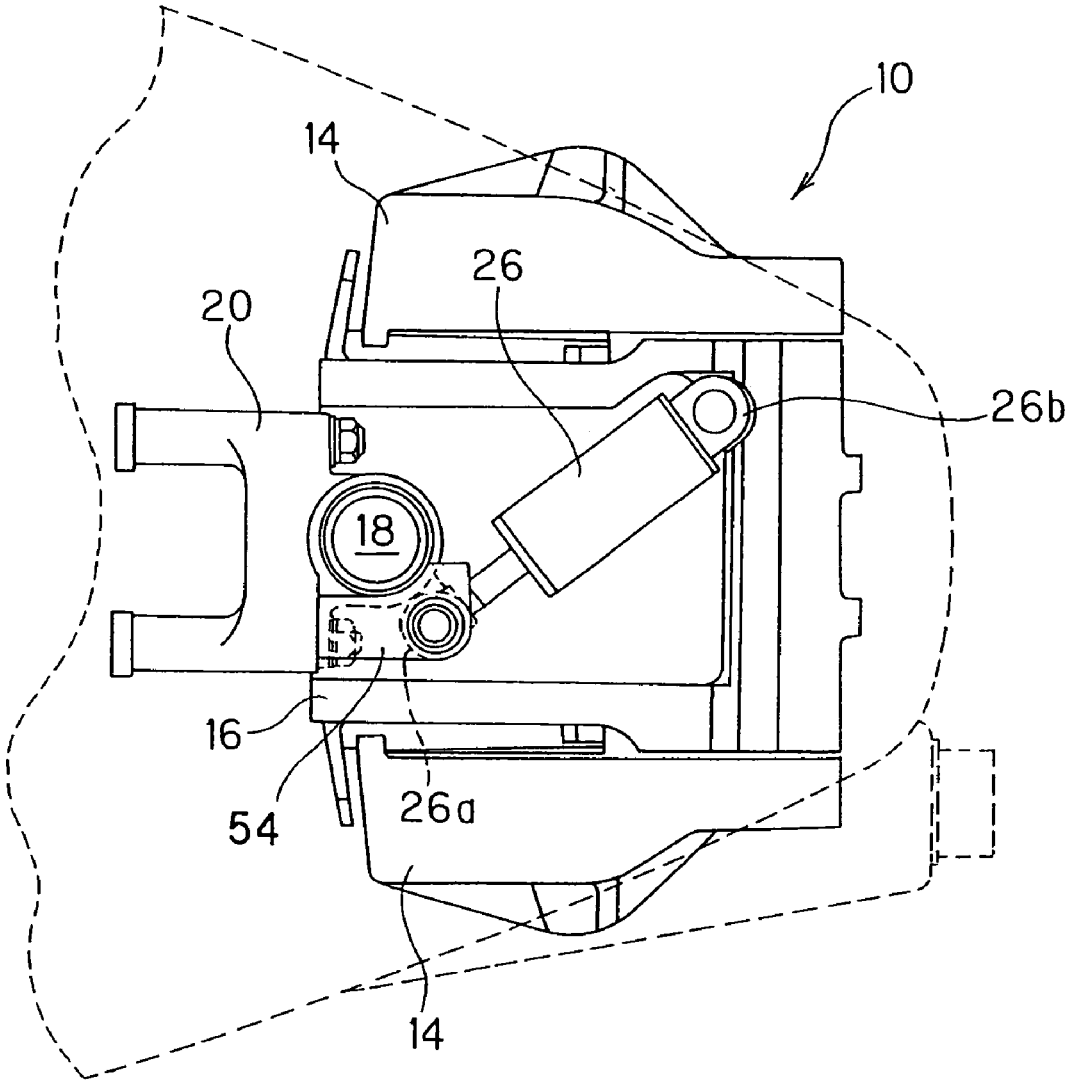
FIG. 4 is a plan view showing the vicinity of the swivel case shown in FIG. 2.

FIG. 4 is a plan view showing the vicinity of the swivel case 16.

As shown in FIGS. 3 and 4, the mount frame 20 is provided with a stay 54 at a location immediately above the swivel shaft 18 or thereabout. A rod head 26*a* of the steering hydraulic cylinder 26 is attached to the stay 54 and a cylinder bottom 26*b* thereof is attached to the swivel case 16. With this, the driving of the steering hydraulic cylinder 26 causes the mount frame 20 and swivel shaft 18 to rotate, thereby steering the outboard motor 10 to the right and left directions. An oil chamber of the steering hydraulic cylinder 26 is connected via an oil path (not shown) with a hydraulic pressure generating unit (explained below) that comprises a hydraulic pump and electric motors.

Figure 5:
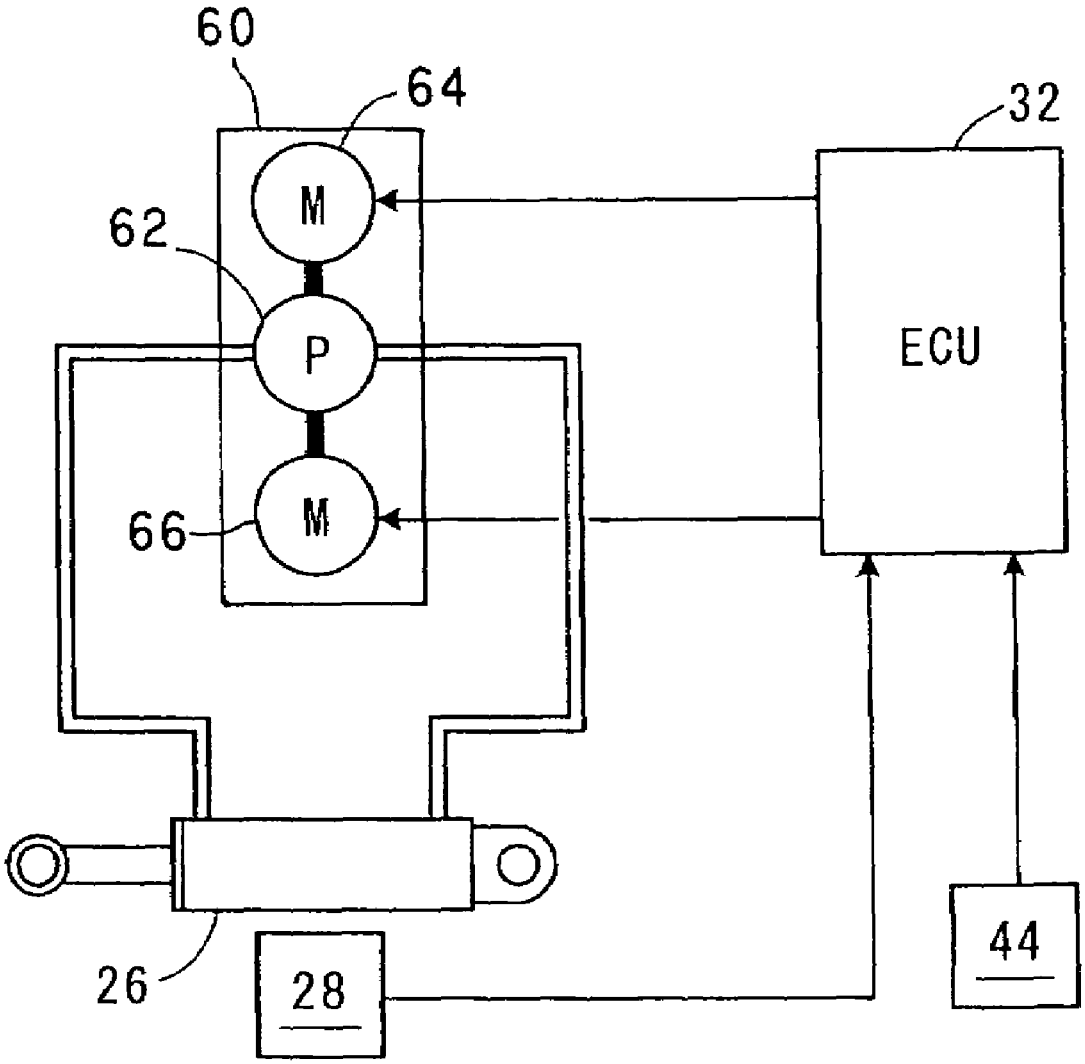
FIG. 5 is a block diagram functionally representing the ECU control of a steering hydraulic cylinder through a hydraulic pressure generating unit.

FIG. 5 is a block diagram functionally representing the control of the ECU 32 of the steering hydraulic cylinder 26 through the hydraulic pressure generating unit.

The aforesaid hydraulic pressure generating unit is designated by reference numeral 60 in FIG. 5. The hydraulic pressure generating unit 60 comprises a hydraulic pump 62 for supplying operating (hydraulic) fluid to the steering hydraulic cylinder 26 and a plurality of, i.e., two electric motors 64, 66 that drive hydraulic pump 62. In the ensuing explanation, the electric motor designated by the reference numeral 64 is called the "first motor" and that designated by the reference numeral 66 is called the "second motor." The output torques produced by the first motor 64 and second motor 66 are predetermined or established to be the same.

As shown in FIG. 5, the outputs of the stroke sensor 28 and the steering wheel sensor 44 are sent to the ECU 32. The ECU 32 controls the operation of the steering hydraulic cylinder 26 so as to make the steering angle detected by the stroke sensor 28 (i.e., the steering angle of the outboard motor 10) a value corresponding to the rotation angle of the steering wheel 42 detected by the steering wheel sensor 44. Specifically, the load acting on the steering hydraulic cylinder 26 (hereinafter sometimes called the "steering load") is detected, the number of motors to be operated is determined based on the detected steering load, and the operation of the motor(s) to be operated is/are controlled.

Where the output torque of the first motor 64 is defined as T1, the output torque of the second motor 66 is defined as T2, and the driving force of the hydraulic pump 62 required when the steering load acting on the steering hydraulic cylinder 26 is maximum is defined as $\alpha$, T1 and T2 are established to satisfy the following inequations.

$$\alpha > T1 \quad \text{. . . Eq. (1)}$$

$$\alpha > T2 \quad \text{. . . Eq. (2)}$$

$$\alpha < T1 + T2 \quad \text{. . . Eq.(3).}$$

In other words, the output torques T1, T2 of the first motor 64 and second motor 66 are predetermined or established such that when the steering load is maximum neither torque is sufficient alone but the two torques are more than sufficient in combination.

Figure 6:
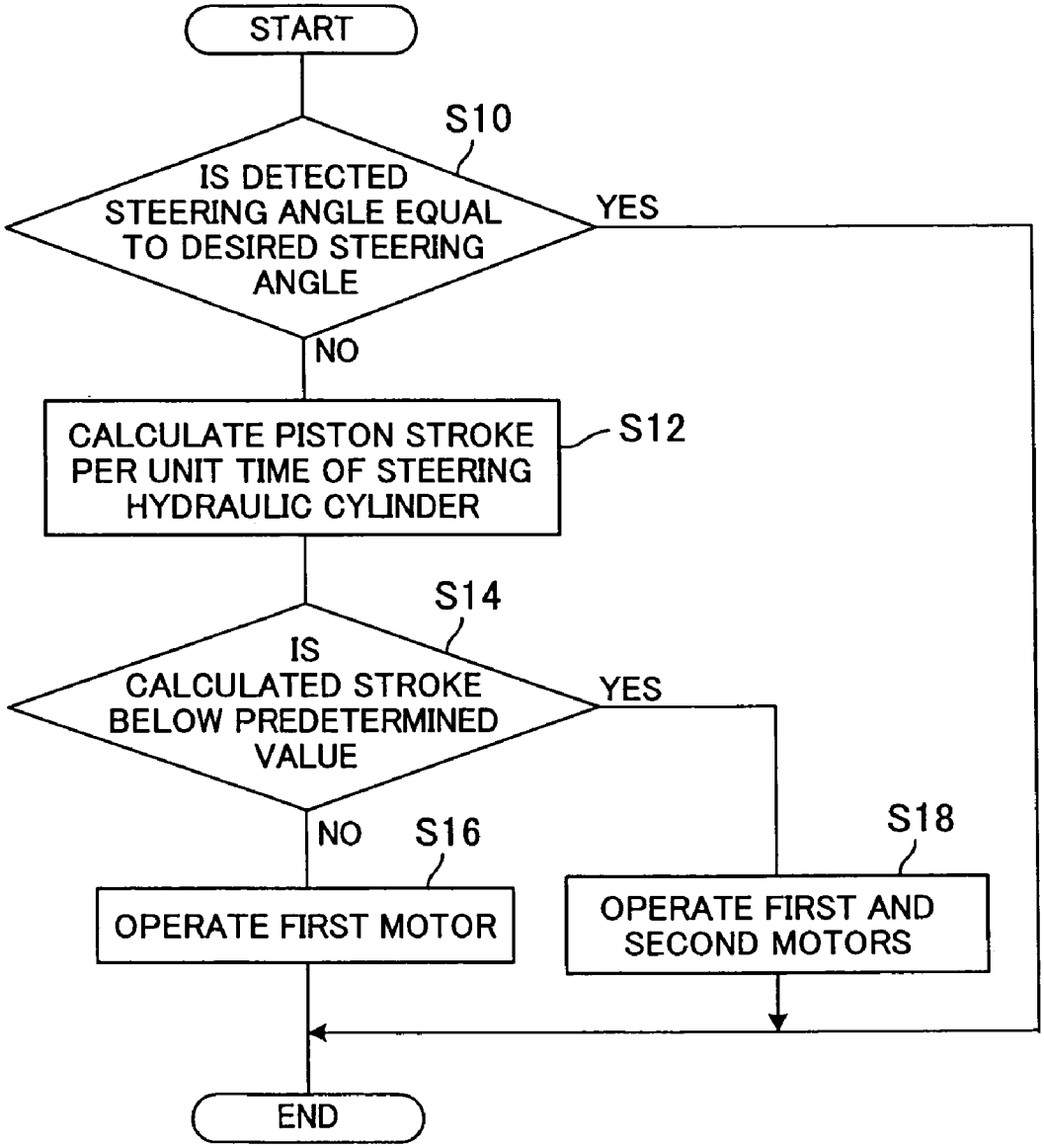
FIG. 6 is a flowchart showing the sequence of processes of the ECU for controlling the operation of the steering hydraulic cylinder shown in FIG. 5.

FIG. 6 is a flowchart showing the sequence of processes of the ECU 32 for controlling the operation of the steering hydraulic cylinder 26, more exactly, controlling the operation of the first motor 64 and second motor 66. The illustrated program is executed in the ECU 32 at prescribed intervals of, for example, 10 milliseconds.

First, in S10, it is determined whether the steering angle detected by the stroke sensor 28 (i.e., the value calculated from the driven stroke of the piston of the steering hydraulic cylinder 26) is equal to a desired steering angle. The desired steering angle is a value calculated from the rotation angle of the steering wheel 42 detected by the steering wheel sensor 44. Specifically, since the steering angle of the outboard motor 10 from the center position to the maximum steering angle is 30 degrees and the rotation angle of the steering wheel 42 from the center position to the maximum rotation angle is 360 degrees, the desired steering angle increases or decreases in increments of 1 degree for each 12 degrees of rotation of the steering wheel 42.

When the result in S10 is YES, the remaining steps of the program are skipped. When it is NO, the program goes to S12, in which the driven stroke of the piston of the steering hydraulic cylinder 26 per unit time (e.g., 1 sec), specifically the amount of change in the steering angle is calculated.

As pointed out in connection with the object of the invention, the steering load of the outboard motor varies greatly depending on, for instance, the type of boat, boat speed, wave height and the like. As mentioned above, the output torques T1, T2 of the individual first and second motors 64, 66 are predetermined at relatively small values at which each torque becomes insufficient when the steering load is large. The amount of piston stroke of the steering hydraulic cylinder 26 per unit time, i.e., the piston stroke speed therefore drops or decreases with increasing steering load. In other words, the magnitude of the steering load of the outboard motor 10 can be estimated by calculating the driven piston stroke of the steering hydraulic cylinder 26 per unit time, i.e., the piston stroke speed.

Next, in S14, it is determined whether the calculated driven piston stroke of the steering hydraulic cylinder 26 per unit time is below a predetermined value. That is, it is determined whether the steering load exceeds a predetermined value.

When the result in S14 is NO, i.e., when the steering load is found to be small, the program goes to S16, in which it is determined that the number of motors to be operated is one, namely that only the first motor 64 is to be operated, and the operation of the first motor 64 is controlled. Specifically, the operation of the first motor 64 is controlled such that the detected value of the steering angle becomes equal to the desired steering angle.

When the result in S14 is YES, i.e., when the steering load is found to be large, the program goes to S18, in which it is determined that the number of motors to be operated is two, namely that both the first motor 64 and second motor 66 are to be operated, and the operation of the first motor 64 and second motor 66 is controlled to make the detected value of the steering angle equal to the desired steering angle. In other words, when the steering load is small, power consumption is minimized by operating only the first motor 64, while when the steering load is large, both of the motors 64 and 66 are operated to increase output torque, thereby boosting the driving force of the hydraulic pump 62 and thus the driving force of the steering hydraulic cylinder 26.

In the foregoing manner, the outboard motor hydraulic mechanism according to this embodiment of the invention is equipped with the two motors 64, 66 serving as power sources of the hydraulic pump 62 for supplying hydraulic (operating) fluid to the steering hydraulic cylinder 26, the steering load acting on the steering hydraulic cylinder 26 is estimated, the number of motors to be operated is determined based on the estimated steering load, and the motor(s) to be operated is/are controlled. Therefore, when the steering load acting on the steering hydraulic cylinder 26 is estimated to be large, the number of motors operated can be increased to produce a large torque, thereby making it possible to operate the steering hydraulic cylinder 26 stably so as to ensure that the operator is not given an unpleasant feeling. On the other hand, when the load acting on the hydraulic actuator is estimated to be small, the number of motors operated is reduced to lower power consumption.

The assignee previously proposed a technique for using multiple motors to drive a hydraulic pump for supplying hydraulic fluid to a hydraulic steering cylinder (patent application Ser. No. 11/153,070 filed on the United States on Jun. 15, 2005; hereinafter called "Prior Application") . As mentioned above, this invention set out in the present specification is directed not only to enabling stable operation of a hydraulic steering cylinder and reduction of electric motor power consumption but also to simplification of the hydraulic mechanism by reducing its number of components. The present invention is distinguished from the invention of the Prior Application in the point that it proposes a layout of the multiple electric motors, which is a point not specifically dealt with by the invention of Prior Application. The layout of the first motor 64 and second motor 66, which is a feature of this invention, will now be explained with reference to FIG. 7.

Figure 7:
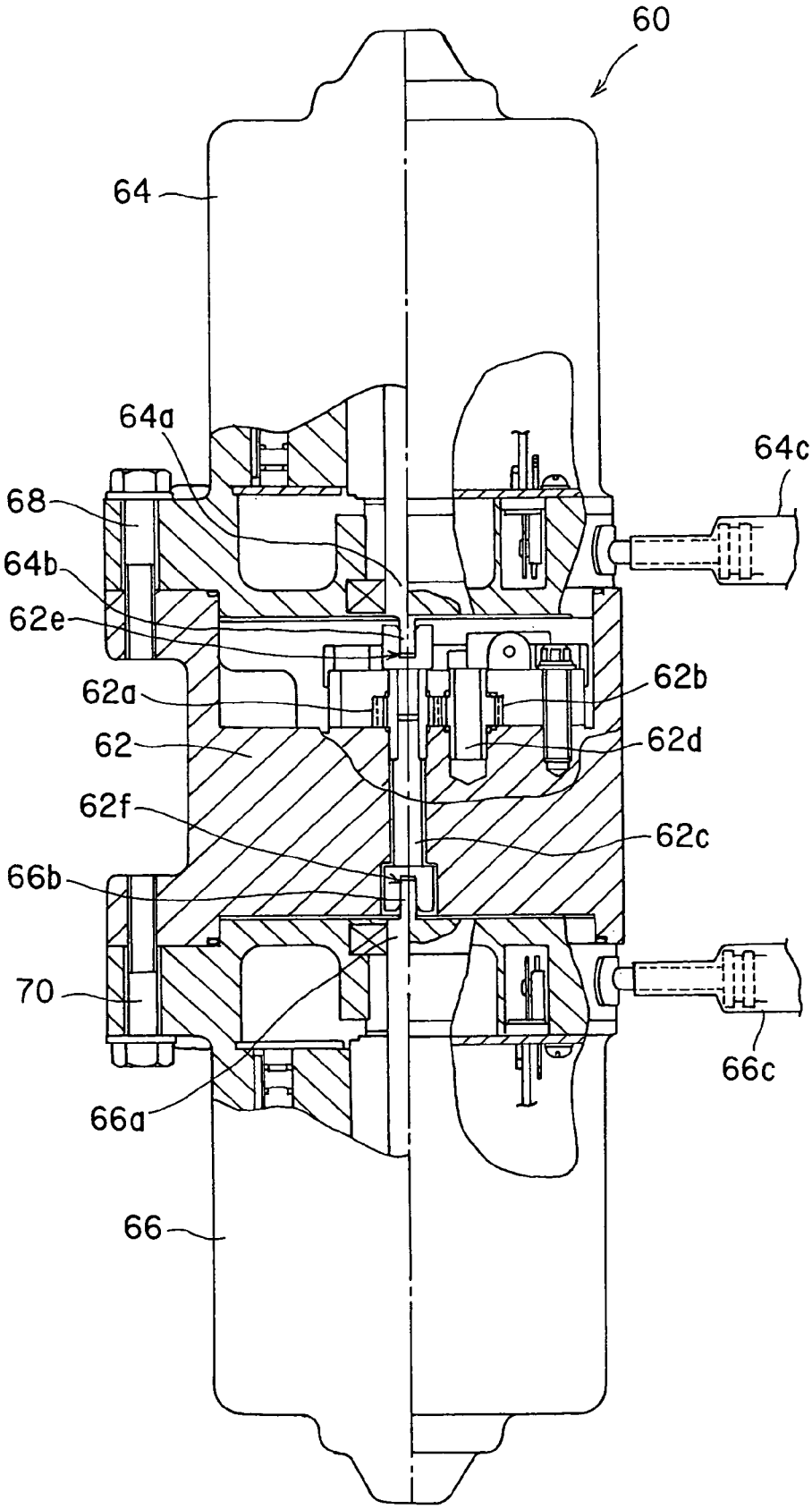
FIG. 7 is a partially sectional view of the hydraulic pressure generating unit of the steering hydraulic cylinder shown in FIG. 5.

FIG. 7 is a partially sectional view of the hydraulic pressure generating unit 60.

As shown in FIG. 7, the first motor 64 and second motor 66 are fastened to opposite side surfaces of the hydraulic pump 62 by bolts 68 and 70. This integrates the first motor 64, second motor 66 and hydraulic pump 62 into a single unit.

The hydraulic pump 62 is a conventional gear pump equipped with a drive gear 62*a* and a driven gear 62*b* meshed therewith. The drive gear 62*a* and driven gear 62*b* are mounted on a drive shaft 62*c* and a drive shaft 62*d*, both of which are rotatably supported by the housing of the hydraulic pump 62. The opposite ends of the drive shaft 62*c* are formed with notches 62*e*, 62*f*.

The first motor 64 is equipped with an output shaft 64*a* and the second motor 66 with an output shaft 66*a*. The ends of the output shafts 64*a*, 66*a* are formed with projections 64*b*, 66*b*. The first motor 64 is equipped with a harness 64*c* and the second motor 66 with a harness 66*c*. The motors 64, 66 are connected to the ECU 32 through the harnesses 64*c*, 66*c*.

As illustrated, the drive shaft 62*c* of the hydraulic pump and the output shaft 64*a* of the first motor are aligned coaxially and are directly connected by inserting the projection 64*b* formed on the output shaft 64*a* into the notch 62*e* formed at one end of the drive shaft 62*c*. Similarly, the drive shaft 62*c* of the hydraulic pump and the output shaft 66*a* of the second motor are aligned coaxially and are directly connected by inserting the projection 66*b* formed on the output shaft 66*a* into the notch 62*f* formed at the other end of the drive shaft 62*c*. Thus the drive shaft 62*c* of the hydraulic pump and the output shafts 64*a*, 66*a* of the two motors are all coaxially aligned, with the output shaft of one motor directly connected to either end of the drive shaft 62*c* of the hydraulic pump.

Therefore, when one or both of the first motor 64 and second motor 66 are operated, the drive shaft 62*c* of the hydraulic pump is rotated, thereby rotating the drive gear 62*a* and driven gear 62*b*. In other words, the hydraulic pump 62 is driven either by the output torque of one of the first motor 64 and second motor 66 or by the combined torque of both the first motor 64 and second motor 66. When the hydraulic pump 62 is driven, hydraulic fluid is supplied to the steering hydraulic cylinder 26. As a result, the steering hydraulic cylinder 26 is driven to rotate the swivel shaft 18 and regulate steering angle of the outboard motor 10.

Thus in the outboard motor hydraulic mechanism according to this embodiment of the invention, the drive shaft 62*c* of the hydraulic pump 62 and the output shafts 64*a*, 66*a* of the motors 64, 66 are coaxially aligned and the drive shaft 62*c* is directly connected to the output shafts 64*a*, 66*a*. This makes it unnecessary to provide gears or other power transmission means between the hydraulic pump 62 and the individual motors 64, 66, thereby reducing the number of components and simplifying the structure.

The output shaft 64*a* of the first motor 64 is directly connected to one end of the drive shaft 62*c* of the hydraulic pump 62 and the output shaft 66*a* of the second motor 66 is directly connected to the other end of the drive shaft 62*c*. This makes it possible to compactly integrate the hydraulic pump 62 and the motors 64, 66 and also to transmit the outputs of the motors 64, 66 to the hydraulic pump 62 with high efficiency.

The embodiment is thus configured to have a hydraulic mechanism of an outboard motor (10) adapted to be mounted on a stem of a boat (12) to be movable about a rotary shaft (e.g., swivel shaft 18) relative to the boat, comprising: a hydraulic actuator (e.g., steering hydraulic cylinder 26) moving the outboard motor about the rotary shaft relative to the boat; a hydraulic pump (62) supplying hydraulic fluid to the hydraulic actuator; a plurality of electric motors (64, 66) connected to the hydraulic pump; and a motor controller (ECU 32, S10 to S18) determining a number of the electric motors to be operated to drive the hydraulic pump based on an estimated load (steering load) acting on the hydraulic actuator and controlling operation of the determined number of the electric motors; wherein output shafts (64*a*, 66*a*) of the electric motors (64, 66) are aligned coaxially with a drive shaft (62*c*) of the hydraulic pump (62), and the output shafts of the electric motors are directly connected with the drive shaft of the hydraulic pump.

In the hydraulic mechanism, the output shaft (64*a*) of one of the electric motors (64) is directly connected with the drive shaft (62*c*) of the hydraulic pump (62) at one end, while the output shaft (66*a*) of another of the electric motors (66) is directly connected with the drive shaft (62*c*) of the hydraulic pump (62) at the other end.

In the hydraulic mechanism, output torques of the electric motors (64, 66) are predetermined such that when the load acting on the hydraulic actuator (steering load) is maximum neither torque is sufficient alone, but the torques are more than sufficient in combination.

In the hydraulic mechanism, the output torques of electric motors (64, 66) are predetermined to be same.

In the hydraulic mechanism, the hydraulic actuator is a hydraulic cylinder (26) that moves the outboard motor (10) about the rotary shaft (swivel shaft 18) relative to the boat to steer the outboard motor.

Although it is explained in the foregoing that two electric motors are provided for driving the hydraulic pump 62, it is instead possible to provide three or more motors for this purpose. When three or more motors are provided, all of the output shafts can be aligned coaxially with the drive shaft of the hydraulic pump by directly connecting the output shafts of the motors with one another.

Moreover, when the first motor 64 and second motor 66 produce different output torques, it is possible when driving only one or the other of them to determine which of the motors is to be driven based on the magnitude of the steering load. For instance, when the output torque T2 of the second motor 66 is predetermined to be larger than the output torque T1 of the first motor 64, it is possible to drive only first motor 64 during low load, only the second motor 66 during medium load, and both the first motor 64 and second motor 66 during high load.

Although it is explained that the hydraulic actuator used is a hydraulic cylinder, it can instead be a hydraulic motor or the like.

Although it is explained that the steering load of the outboard motor 10 is estimated based on the output of the stroke sensor 28, the detection can instead be made using some other parameter. For instance, the steering load of the outboard motor 10 can be estimated from the rotation angle of the swivel shaft 18, or from the speed of the engine 30 or the speed of the boat 12.

Although in the foregoing description the swivel shaft 18 is exemplified as the rotary shaft driven by the plurality of motors, the configuration according to this invention can also be applied to the tilting shaft 22. In other words, the hydraulic pump for supplying hydraulic fluid to the tilt hydraulic cylinder 40*a* or the trim hydraulic cylinder 40*b* can be driven by a plurality of electric motors. In this case, the load acting on the hydraulic cylinders 40*a*, 40*b* can be estimated by detecting the amount of driving of the tilt hydraulic cylinder 40*a* or trim hydraulic cylinder 40*b*, or the rotation angle of the tilting shaft 22.

Japanese Patent Application No. 2004-323244 filed on Nov. 8, 2004 is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A hydraulic mechanism of an outboard motor adapted to be mounted on a stern of a boat to be movable about a rotary shaft relative to the boat, comprising:

a hydraulic actuator which moves the outboard motor about the rotary shaft relative to the boat;

a hydraulic pump which supplies hydraulic fluid to the hydraulic actuator;

a plurality of electric motors connected to the hydraulic pump; and a motor controller which determines a number of the electric motors to be operated to drive the hydraulic pump based on an estimated load acting on the hydraulic actuator and controlling operation of the determined number of the electric motors;

wherein output shafts of the electric motors are aligned coaxially with a drive shaft of the hydraulic pump, and the output shafts of the electric motors are directly connected with the drive shaft of the hydraulic pump.

2. The hydraulic mechanism according to claim 1, wherein the output shaft of one of the electric motors is directly connected with the drive shaft of the hydraulic pump at one end, while the output shaft of another of the electric motors is directly connected with the other end of the drive shaft of the hydraulic pump.

3. The hydraulic mechanism according to claim 1, wherein output torques of the electric motors are predetermined such that when the estimated load acting on the hydraulic actuator is maximum neither torque is sufficient alone but the torques are more than sufficient in combination.

4. The hydraulic mechanism according to claim 3, wherein the output torques of the electric motors are predetermined to be the same.

5. The hydraulic mechanism according to claim 1, wherein the hydraulic actuator is a hydraulic cylinder that moves the outboard motor about the rotary shaft relative to the boat to steer the outboard motor.

6. A hydraulic mechanism of an outboard motor adapted to be mounted on a stern of a boat to be movable about a rotary shaft relative to the boat, comprising:

a hydraulic actuator which moves the outboard motor about the rotary shaft relative to the boat;

a hydraulic pump which supplies hydraulic fluid to the hydraulic actuator;

a plurality of electric motors connected to the hydraulic pump for driving the pump; and a motor controller determining which of the electric motors to be operated to drive the hydraulic pump based on an estimated load acting on the hydraulic actuator, and controlling operation of the determined electric motors;

wherein output shafts of the electric motors are aligned coaxially with and directly connected to a drive shaft of the hydraulic pump.

7. The hydraulic mechanism according to claim 6, wherein the output shaft of one of the electric motors is directly connected with one end of the drive shaft of the hydraulic pump, while the output shaft of another of the electric motors is directly connected with the other end of the drive shaft of the hydraulic pump.

8. The hydraulic mechanism according to claim 6, wherein output torques of the electric motors are predetermined such that when the estimated load acting on the hydraulic actuator is maximum none of the output torques is sufficient alone to drive the hydraulic pump, but collectively the output torques are more than sufficient to drive the hydraulic pump.

9. The hydraulic mechanism according to claim 8, wherein the output torques of the electric motors are predetermined to be the same.

10. The hydraulic mechanism according to claim 1, wherein the hydraulic actuator is a hydraulic cylinder that moves the outboard motor about the rotary shaft relative to the boat to steer the outboard motor.

* * * * *